US007325372B2

(12) United States Patent
Bernhard

(10) Patent No.: US 7,325,372 B2
(45) Date of Patent: Feb. 5, 2008

(54) BEVERAGE BOTTLING PLANT FOR FILLING BOTTLES WITH A LIQUID BEVERAGE MATERIAL HAVING A BOTTLE CLOSING MACHINE FOR APPLYING SCREW CAPS TO BOTTLES

(75) Inventor: Herbert Bernhard, Wolfsheim (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 61 days.

(21) Appl. No.: 11/282,948

(22) Filed: Nov. 18, 2005

(65) Prior Publication Data

US 2006/0123738 A1 Jun. 15, 2006

(30) Foreign Application Priority Data

Nov. 19, 2004 (DE) ..... 10 2004 056 040

(51) Int. Cl.
*B65B 7/28* (2006.01)

(52) U.S. Cl. ..... 53/300; 53/317; 53/331.5

(58) Field of Classification Search ..... 53/300, 53/317, 329, 331.5, 490; 198/370.03, 481.1
See application file for complete search history.

(56) References Cited

U.S. PATENT DOCUMENTS 2,713,960 A 7/1955 Siegel
3,807,134 A * 4/1974 Zalkin ..... 53/381.4
3,844,093 A * 10/1974 Cato ..... 53/381.4
3,850,284 A 11/1974 Roberts
4,572,033 A * 2/1986 Vanderbush et al. ..... 81/3.2
4,596,107 A * 6/1986 Pfleger, Sr. ..... 53/53
4,624,098 A * 11/1986 Trendel ..... 53/314
4,939,890 A * 7/1990 Peronek et al. ..... 53/486
5,423,159 A * 6/1995 Bankuty et al. ..... 53/317
5,457,939 A * 10/1995 Bardou et al. ..... 53/432

(Continued)

FOREIGN PATENT DOCUMENTS

DE 19 17 667 A1 10/1970

(Continued)

OTHER PUBLICATIONS

European Patent Office Search Report EP 1 659 088 A1 and English translation thereof.

*Primary Examiner*—Rinaldi I. Rada
*Assistant Examiner*—Gloria R. Weeks
(74) *Attorney, Agent, or Firm*—Nils H. Ljungman & Associates

(57) ABSTRACT

A beverage bottling plant for filling bottles with a liquid beverage material having a bottle closing machine for applying screw caps to bottles. The abstract of the disclosure is submitted herewith as required by 37 CF. §1.72(b). As stated in 37 CF. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

19 Claims, 4 Drawing Sheets

U.S. PATENT DOCUMENTS

| | | | | | |
|---|---|---|---|---|---|
| 5,473,855 | A * | 12/1995 | Hidding et al. | 53/314 |
| 5,934,042 | A * | 8/1999 | Peronek | 53/317 |
| 6,023,910 | A * | 2/2000 | Lubus et al. | 53/317 |
| 6,871,482 | B2 * | 3/2005 | Cirio | 53/490 |
| 6,978,819 | B2 * | 12/2005 | Tanaka et al. | 156/566 |
| 7,028,857 | B2 * | 4/2006 | Peronek | 215/40 |
| 7,162,849 | B2 * | 1/2007 | Bernhard | 53/317 |

FOREIGN PATENT DOCUMENTS

| | | | |
|---|---|---|---|
| DE | 37 33 958 | A1 | 4/1989 |
| DE | 202 18 523 | U1 | 4/2003 |
| EP | 1 295 841 | A | 3/2003 |
| EP | 1 424 307 | A | 6/2004 |
| JP | 2002-284289 | A | 10/2002 |

* cited by examiner

FIG. 3
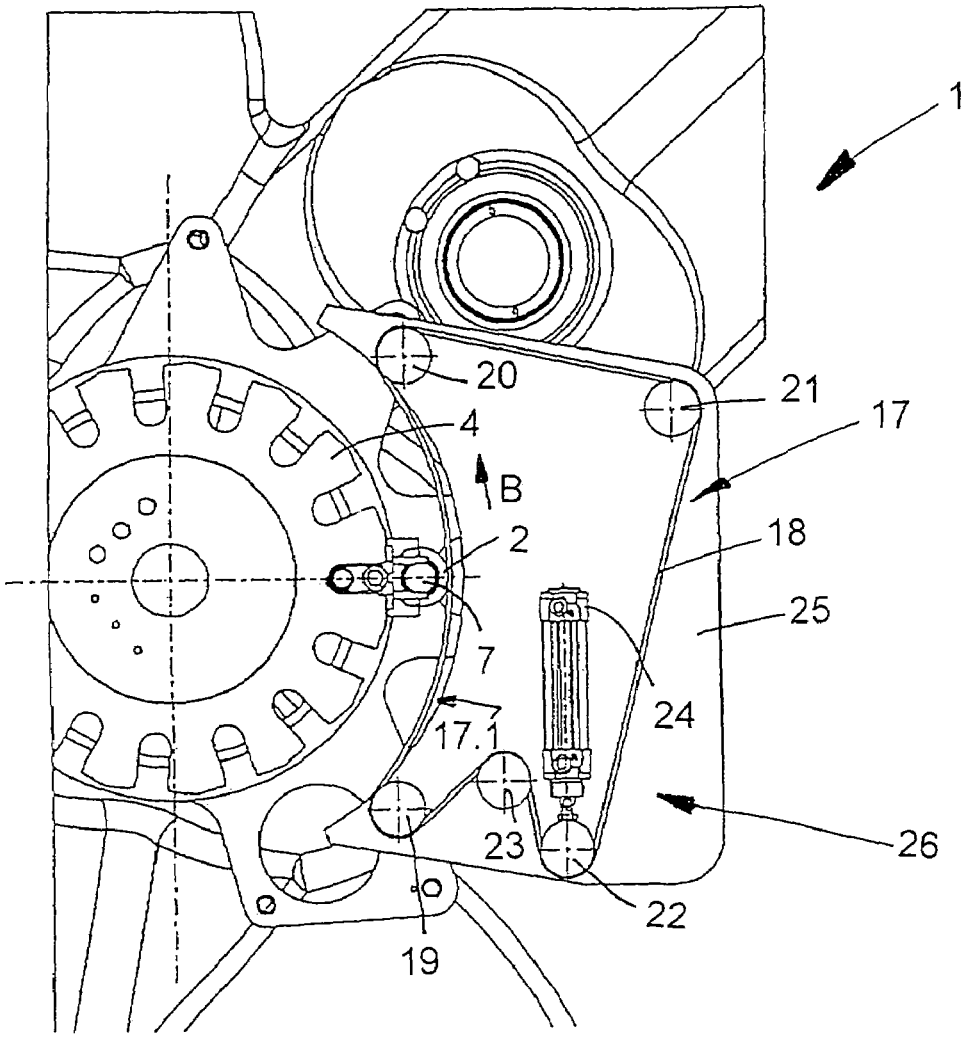
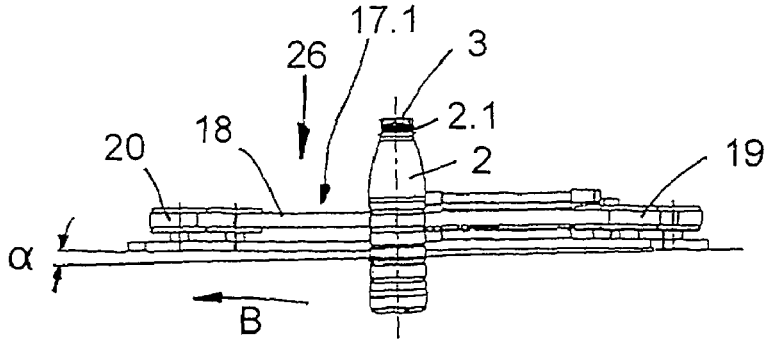
FIG. 4

BEVERAGE BOTTLING PLANT FOR FILLING BOTTLES WITH A LIQUID BEVERAGE MATERIAL HAVING A BOTTLE CLOSING MACHINE FOR APPLYING SCREW CAPS TO BOTTLES

BACKGROUND

1. Technical Field

The present application relates to a beverage bottling plant for filling bottles with a liquid beverage material having a bottle closing machine for applying screw caps or screw tops to bottles.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Capping machines for the capping of bottles with screw caps that are fastened by fitting or screwing onto a male thread on the bottle in the vicinity of the bottle mouth are known in various models. Basically, the application of the individual cap is performed with a capping element or capping cone in which the bottle cap is held until it is applied to a bottle, and which can be rotated by a drive to place the cap on the bottle or to screw the cap onto the bottle.

On a machine of this type it is essential that during the application of the cap, i.e. during the tightening process, the bottle in question must be secured to prevent it from rotating along with the capping cone, i.e. so that it is held non-rotationally, and also so that the bottle can execute a tracking movement during the tightening process to compensate for the reduction of the total bottle/cap length that occurs.

Capping machines of the prior art have a plurality of capping positions on a rotor that can be driven around a vertical machine axis, each of which capping positions has a capping cone and a bottle or container carrier which, when the rotor rotates, can be moved up and down in a movement controlled by a lifting cam, and specifically to deliver the individual bottle to the capping cone before the tightening and for the extraction of the capped bottle from the capping cone.

The tracking movement of the bottles during the tightening on capping machines of the prior art is also achieved by raising the bottle carrier. One problem on these capping machines is the difficulty of securing the bottles to prevent rotation, particularly when the bottles in question are returnable bottles and especially returnable plastic or PET bottles. Of course, on disposable PET bottles, the bottles can be secured to prevent rotation during the tightening process by spikes. With returnable bottles, however, and in particular with returnable PET bottles, this method cannot be used simply because of the damage that results and increases as the speed of revolution increases, which damage is found to be unacceptable by consumers.

OBJECT OR OBJECTS

The object is to indicate a capping machine that guarantees a gentle handling of the bottles during the capping or tightening and for that reason is preferably but not exclusively also suitable for use with returnable PET bottles. To accomplish this object, the present application teaches a capping machine as disclosed herein below.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the embodiments are described in the dependent claims. The present application is explained in greater detail below with reference to one exemplary embodiment which is illustrated in the accompanying figures, in which:

FIG. 3 is a partial view from overhead of the capping machine illustrated in FIG. 1;

FIG. 4 is a schematic illustration that explains an embodiment.

DESCRIPTION OF EMBODIMENT OR EMBODIMENTS

Figure 1A:
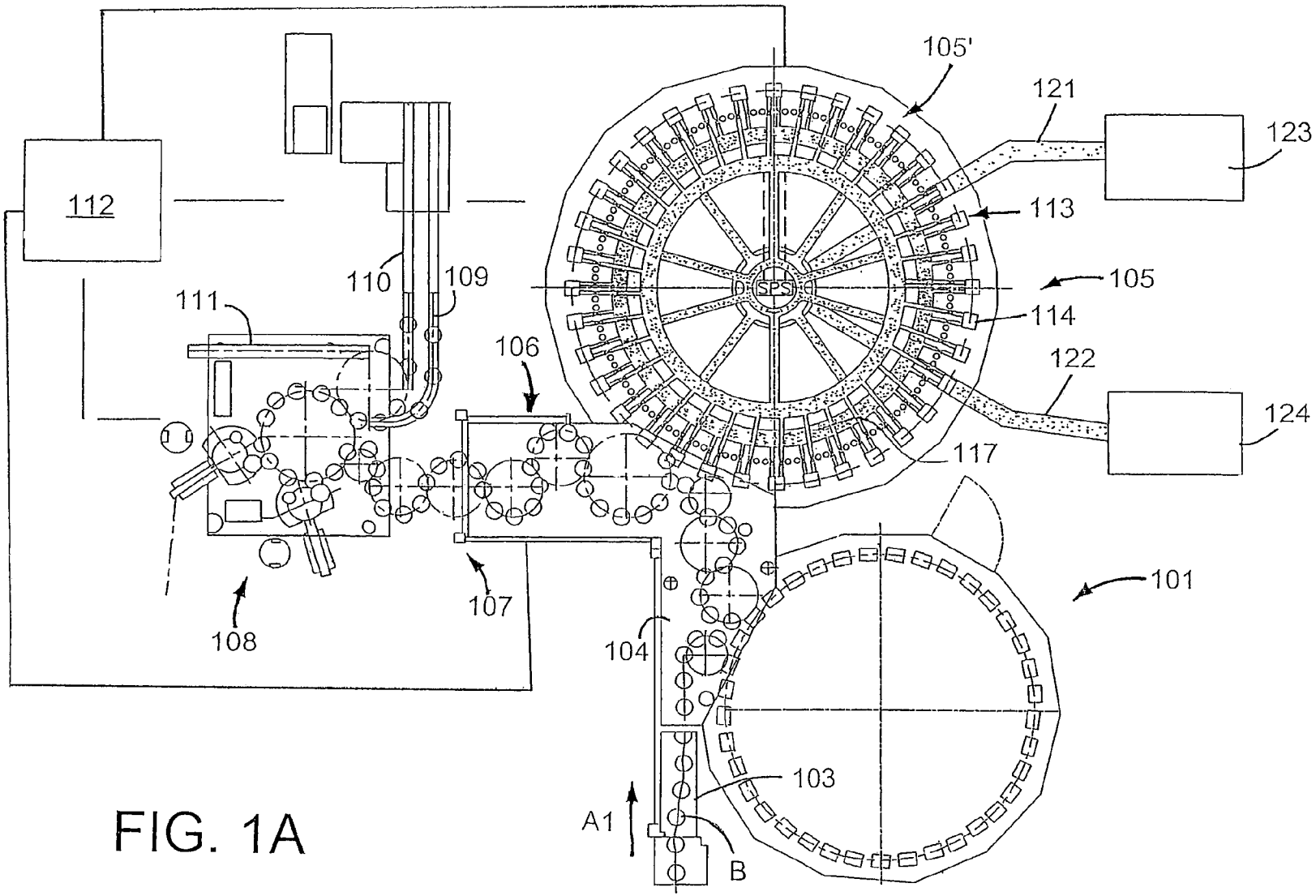
FIG. 1A is a schematic illustration of a container filling plant in accordance with one possible embodiment.

FIG. 1A shows schematically the main components of one possible embodiment example of a system for filling containers, specifically, a beverage bottling plant for filling bottles B with at least one liquid beverage, in accordance with at least one possible embodiment, in which system or plant could possibly be utilized at least one aspect, or several aspects, of the embodiments disclosed herein.

FIG. 1A shows a rinsing arrangement or rinsing station 101, to which the containers, namely bottles B, are fed in the direction of travel as indicated by the arrow A1, by a first conveyer arrangement 103, which can be a linear conveyor or a combination of a linear conveyor and a starwheel. Downstream of the rinsing arrangement or rinsing station 101, in the direction of travel as indicated by the arrow A1, the rinsed bottles B are transported to a beverage filling machine 105 by a second conveyer arrangement 104 that is formed, for example, by one or more starwheels that introduce bottles B into the beverage filling machine 105.

The beverage filling machine 105 shown is of a revolving or rotary design, with a rotor 105', which revolves around a central, vertical machine axis. The rotor 105' is designed to receive and hold the bottles B for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles B to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 1A, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle B, the first product or the second product can be filled by means of an appropriate control of the filling product or fluid valves.

Downstream of the beverage filling machine 105, in the direction of travel of the bottles B, there can be a beverage bottle closing arrangement or closing station 106 which closes or caps the bottles B. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles B. In the embodiment shown, the labeling arrangement 108 has three output conveyer arrangement: a first output conveyer arrangement 109, a second output conveyer arrangement 110, and a third output conveyer arrangement 111, all of which convey filled, closed, and labeled bottles B to different locations.

The first output conveyer arrangement 109, in the embodiment shown, is designed to convey bottles B that are filled with a first type of liquid beverage supplied by, for example, the supply reservoir 123. The second output conveyer arrangement 110, in the embodiment shown, is designed to convey bottles B that are filled with a second type of liquid beverage supplied by, for example, the supply reservoir 124. The third output conveyer arrangement 111, in the embodiment shown, is designed to convey incorrectly labeled bottles B. To further explain, the labeling arrangement 108 can comprise at least one beverage bottle inspection or monitoring device that inspects or monitors the location of labels on the bottles B to determine if the labels have been correctly placed or aligned on the bottles B. The third output conveyer arrangement 111 removes any bottles B which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The capping machine, which in the accompanying figures is designated 1 in general, is used for the capping of bottles 2 which, in the illustrated exemplary embodiment, are returnable PET bottles, each of which is provided with a cap 3, and specifically by the placement or screwing of the cap 3 onto a bottle-side male thread that is provided in the vicinity of the mouth of the bottle.

Figure 2:
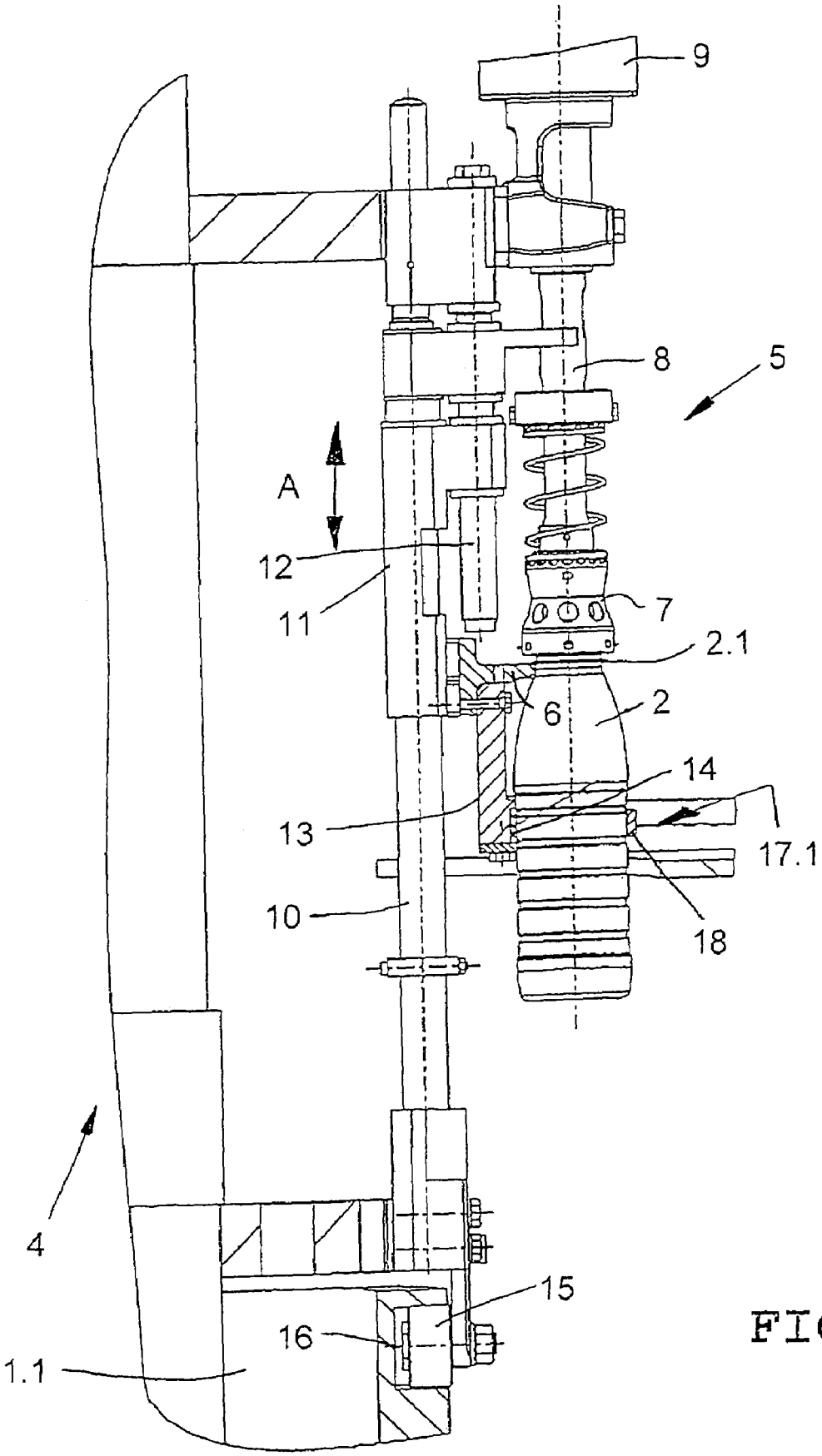
FIG. 2 is a detailed view in partial section of one of the capping stations of the capping machine illustrated in FIG. 1.

The capping machine 1 comprises, in the manner described in the prior art, a rotor 4 which is driven so that it rotates around a vertical machine axis MA. On the periphery of the rotor, a plurality of capping positions 5 are formed which, among other things, each have a bottle carrier 6 and, above that in the vertical direction, a capping tool or a capping cone 7. The capping cone 7 is fastened on the lower end of a shaft 8 which is oriented with its axis parallel to the machine axis MA. In FIG. 2, 9 is a schematic indication of a drive which is provided for each capping position 5, and with which the respective shaft 8 and thus also the capping cone 7 can be driven in rotation to screw the cap 3 onto a bottle 2.

In the illustrated exemplary embodiment, the bottle carriers 6 are realized in a fork shape with a fork aperture that is open toward the periphery of the rotor 4, so that the bottle 2 in a capping position 5 is grasped from below by the fork-like bottle carrier 6 on a ring-shaped flange or edge 2.1 that projects beyond the outside of the bottle below the bottle mouth, or is held on the fork-shaped bottle carrier 6 by this ring-shaped flange or edge 2.1.

Associated with each capping position 5 is a lifting rod 10, which is oriented with its axis parallel to the machine axis MA and is offset radially inward in relation to this machine axis with respect to the respective bottle carrier 6. On each lifting rod, which is guided on the rotor for an axial movement or an axial stroke (double arrow A in FIG. 2), an individual carrier 11 is fastened, which is also guided on a guide rod 12 that is fastened to the rotor 4 to prevent it from rotating.

Fastened to each carrier 11 are the bottle carriers 6 and underneath the bottle carrier 6, a support element or molding 13 which has a pocket-like recess that is open toward the periphery of the rotor 4 for the body of the individual bottle 2, which support surface is provided with a friction lining 14 that has a high coefficient of friction, for example, a friction lining 14 made of rubber, and which support surface surrounds the respective bottle 2 over a relatively large part of its periphery, for example more than half the periphery or approximately half the periphery. Each lifting rod 10 is provided on the bottom end with a cam roller 15 which is engaged in a lifting cam 16 which is provided on a part 1.1 of the capping machine 1 that does not rotate with the rotor 4, so that when the rotor is rotating, the respective lifting rod 11 and thus also the bottle carrier 6 and the molding 13 that are connected with the lifting rod 11 can be moved up and down in a controlled manner.

The general function of the capping machine 1 can be described in simplified terms as follows. When the rotor 4 is rotating around the machine axis MA, the bottles 2 to be capped are each fed individually at a bottle inlet to a capping position 5 and, the bottles 2 provided with their individual caps 3 are delivered at a bottle outlet to a conveyor for further processing, e.g. for labeling. Between the bottle outlet and the bottle inlet there is a station in which each capping cone 7, as it moves past, receives a cap 3.

The bottle 2 that arrives at a capping position 5 where it is held on the bottle carrier 6, in an angular section of the rotational movement of the rotor 4 that follows the bottle inlet, is first raised by an upward movement of the lifting rod 10 or by the corresponding profile of the lifting cam 16 far enough that the bottle 2 extends with its mouth area into the capping cone 7 and is in contact with the cap 3 that is inside the capping cone, as illustrated in FIG. 2. Over another angular section of the rotational movement of the rotor 4, the cap 3 is placed on the bottle or screwed on by means of the capping cone which is driven in rotation around the axis of the shaft 8. The respective bottle 2 thereby tracks this movement by a further elevation of the bottle carrier 6.

After the capping, in a further angular segment of the rotational movement of the rotor 4, the respective bottle carrier 6 and the capped bottle 2 that is being held on it are lowered with the lifting rod 10, and thus the bottle 2 is extracted from the capping cone 7.

While the cap 3 is being tightened, it is necessary for the respective bottle 2 in the capping position 5 to be secured to prevent it from rotating around its vertical bottle axis. In the illustrated exemplary embodiment, this is achieved on one hand because the respective bottle is in contact with the friction lining 14, and is pressed by a driven belt 18 that forms a closed loop 17 and in the vicinity of the loop length 17.1 is in contact against all the bottles 2, each of which is located in the angular portion of the rotational movement of the rotor 4 in which the capping of the bottles 2 takes place by the rotation of the respective cap 3 and in which the bottles 2 are for this purpose held non-rotationally in the respective capping position 5, and must also be guided so that they track the tightening movement. The belt 18 is in contact against the body area of the bottles 2 over the loop length 17.1, and namely diametrically opposite the friction lining 14 with reference to the respective bottle axis.

Figure 1:
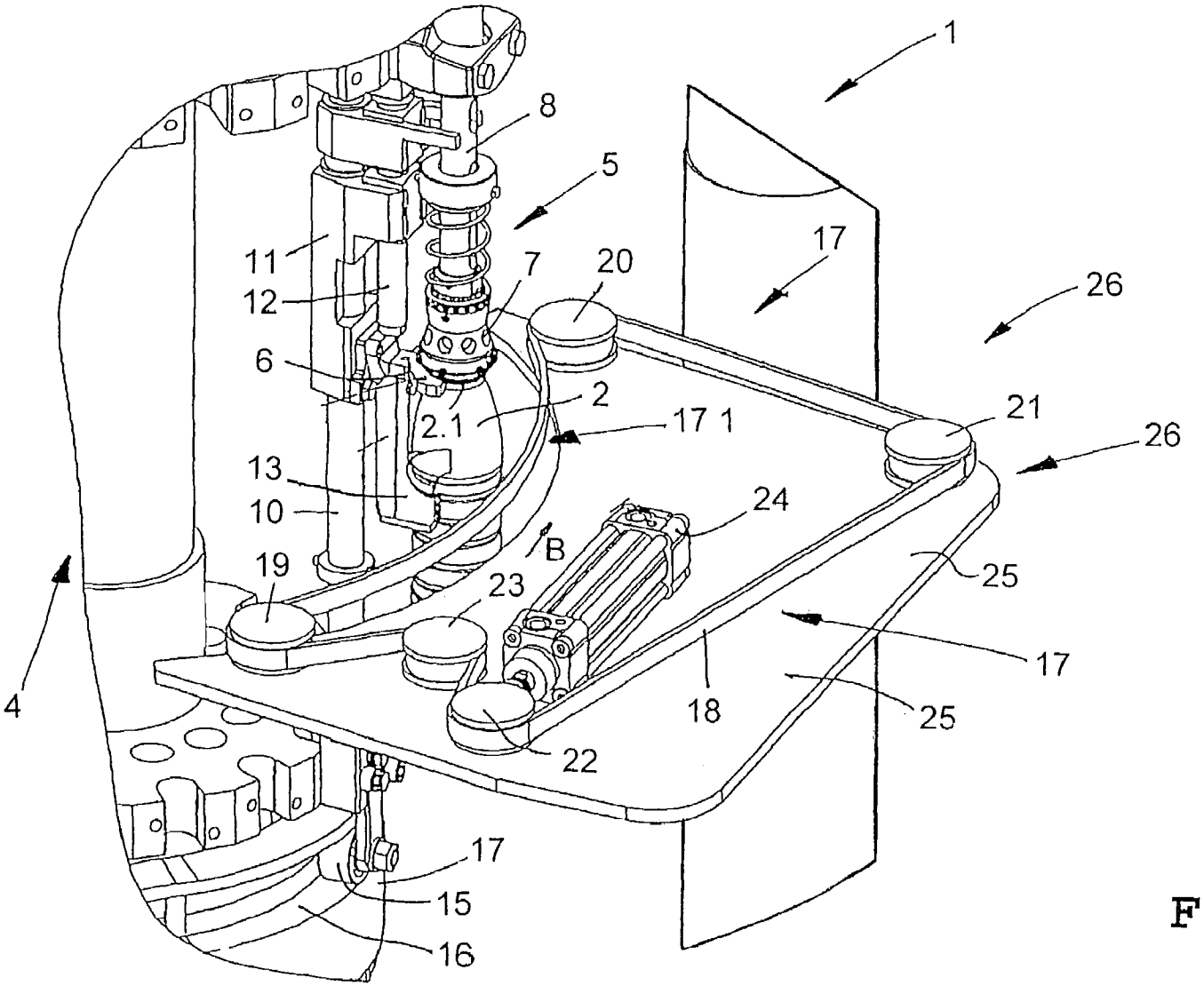
FIG. 1 is a partial view in perspective of a capping machine in accordance with one possible embodiment.

As illustrated in FIG. 1, the belt 18 is guided over a plurality of pulleys or rollers 19-23 to form the loop 17, of which the rollers 22 and 23 form a tensioning device for said belt 18 and the roller 22 is biased by a pneumatic cylinder 24 that acts as an air spring for a movement radial to its roller axis. The loop length 17.1 that interacts with the bottles 2 is formed between the two rollers 19 and 20. Because the belt over this length, as shown in the simplified illustration in the drawing, is in contact not only with a single bottle 2, but with a plurality of bottles 2 in a plurality of capping positions 5 simultaneously, the loop length 17.1 has a profile that is approximately in the shape of a circular arc.

All the rollers 19-23 are mounted on a common carrier 25, which is illustrated in the drawings in the form of a plate or table, and specifically around axes that run parallel to one another and are oriented perpendicular to the plane of the carrier 25. The carrier 25 is fastened to the machine frame of the capping machine 1 so that the belt system formed by the belt 18, the rollers 19-23 and the carrier 25 does not rotate with the rotor 4, but the bottles are in contact with the loop length 17.1 in their peripheral area which is outboard with reference to the machine axis MA.

With one of the rollers, for example with the roller 20, the belt is driven by a drive system (not shown), so that the belt 18 is moved in the loop length 17.1 that is formed between the two rollers 19 and 20 in the same direction and at the same peripheral velocity as the rotor 4 or as the contact points with the bottles 2 (Arrow B), so that the bottles 2 in question are protected or biased between the length 17.1 and the friction lining 14 against rotation around their vertical bottle axis, and in particular the belt 18 does not introduce any forces into the bottles 2 that might effect a rotation of said bottles.

To allow the bottles that are held non-rotationally between the respective molding and the belt 18 to execute a tracking movement during the cap tightening process by a further elevation of the bottle carrier 6 and the molding 13, the loop length 17.1 that extends between the rollers 19 and 20 has a profile that ascends at an angle in the direction of movement B, which corresponds to the ascent of the lifting cam 16 during the tracking movement of the bottles 2 and encloses an angle alpha, which is indicated schematically in FIG. 4, with a horizontal plane that is oriented perpendicular to the machine axis MA. Consequently, even during the tracking movement or elevation of the bottles 2 necessary for the tightening process, no forces are exerted by the belt 18 on the bottles 2 that are in contact against the belt 18. This inclination of the belt 18 over the loop length 17.1 is achieved by a corresponding inclination of the carrier 25 and/or of the entire belt system 26.

The present application was described above on the basis of one exemplary embodiment. It goes without saying that modifications and variations are possible without thereby going beyond the teaching of the present application.

Therefore it is possible, for example, to make the belt 18 out of a material that has a lower coefficient of friction than the friction lining 14, so that the bottles 2 are secured against rotation during the cap tightening process by the friction lining 14 of the moldings 13, while the belt 18 acts essentially only to press the bottles 2 against said friction lining 14. Basically, however, it is also possible to manufacture the belt 18, at least on its belt side that forms the outside of the closed loop 17, from a material that has a higher coefficient of friction.

Other belt systems which drive the loop length 17.1 in a similar manner in contact with the bottles 2 as the embodiments described in detail herein are also envisaged by the present application.

On a machine for the capping bottles or similar containers with a plurality of capping positions formed on the periphery of a rotor that can be driven in rotation around a vertical machine axis, each of which capping positions has a capping tool that can be driven in rotation by a drive system for the application of a cap by screwing or tightening process and a container carrier for the elevation of the respective container to bring it closer to the capping tool before the tightening process and for the tracking movement of the container during the tightening process, and with means to secure the individual container against rotation at least during the tightening process.

One feature or aspect of an embodiment is believed at the time of the filing of this patent application to possibly reside broadly in a machine for capping bottles or similar containers with caps by applying the caps or screwing them down, with a plurality of capping positions formed on the periphery of a rotor that can be driven in rotation around a vertical machine axis, each of which capping positions has a capping tool that can be driven in rotation by a drive system for the application of a cap by screwing or tightening process and a container carrier for the elevation of the respective container during the approach to the capping tool before the tightening process and for the tracking movement of the container during the tightening process, and with means to secure the individual container against rotation at least during the tightening process, characterized in that to secure the containers against rotation during the tightening process, each capping position has at least one container stop that has an elevated coefficient of friction for a lateral stop or support of the respective container, that to press the respective container against the container stop, there is at least one belt system with at least one belt that can be driven in rotation that forms an endless loop, which belt is in contact over a loop length against the containers during the tightening process, and moves synchronously with said loop length and in the same direction as the rotation of the rotor.

Another feature or aspect of an embodiment is believed at the time of the filing of this patent application to possibly reside broadly in a capping machine, characterized in that the loop length is offset radially outward with respect to the container stop toward the machine axis.

Yet another feature or aspect of an embodiment is believed at the time of the filing of this patent application to possibly reside broadly in a capping machine, characterized in that the loop length extends over at least one angular area of the rotational motion of the rotor in which the tightening process occurs.

Still another feature or aspect of an embodiment is believed at the time of the filing of this patent application to possibly reside broadly in a capping machine, characterized in that the loop length has a diagonally ascending profile in the direction of motion of the belt.

A further feature or aspect of an embodiment is believed at the time of the filing of this patent application to possibly reside broadly in a capping machine, characterized in that the ascent of the loop length is equal to the profile of a control or lifting cam that controls the movement of the respective container carrier.

Another feature or aspect of an embodiment is believed at the time of the filing of this patent application to possibly reside broadly in a capping machine, characterized in that the at least one belt is guided by a plurality of rollers and that at least one roller is driven.

Yet another feature or aspect of an embodiment is believed at the time of the filing of this patent application to possibly reside broadly in a capping machine, characterized in that the loop length that is in contact against the containers extends between at least two rollers, and that the final roller of the loop length is driven in the direction of rotation of the rotor or in the direction of circulation of the belt.

Still another feature or aspect of an embodiment is believed at the time of the filing of this patent application to possibly reside broadly in a capping machine, characterized in that the rollers are mounted on a common carrier, which is inclined with respect to the horizontal so that it corresponds to the profile of the loop length.

Yet another feature or aspect of an embodiment is believed at the time of the filing of this patent application to possibly reside broadly in a beverage bottle screwtop closing arrangement configured to screw screwtops onto filled screwtop beverage bottles in a beverage bottling plant; a first conveyor arrangement being configured and disposed to move bottles into said beverage bottle screwtop closing arrangement; said first conveyor arrangement comprising a star wheel structure; said beverage bottle screwtop capper comprising: a rotor being disposed on a vertical axis; a motor system being configured to rotate said rotor about a vertical axis; a rotatable vertical machine column; said rotor being connected to said vertical machine column to permit rotation of said rotor about said vertical machine column; a plurality of closing devices being disposed on the periphery of said rotor; each of said plurality of closing devices comprising: a drive motor being configured and disposed to drive each of said plurality of closing devices to screw a cap onto a screwtop bottle; a screw head being configured to screw screw caps onto a screwtop bottle upon bottles being filled; a container carrier element being configured and disposed to receive and hold screwtop bottles; said container carrier element comprising a friction lining being configured and disposed to substantially prevent screwtop bottles from rotating during bottle closing; a lifting apparatus being configured and disposed to lift said container carrier element in a first lifting direction toward its corresponding screw head, and to move said container carrier element in a second lowering direction away from its corresponding screw head upon screwtop bottles being closed; a cam structure being connected to said lifting apparatus; said cam structure being configured and disposed to lift said lifting apparatus in a first lifting direction toward its corresponding screw head, and to hold said lifting apparatus in a position to permit a screw cap to be screwed onto a screwtop bottle; said cam structure being configured and disposed to move said lifting apparatus in a second lowering direction away from its corresponding screw head upon screwtop bottles being closed; said closing machine further comprising a belt system being configured and disposed to secure screwtop bottles from rotating during the bottle closing process; said belt system comprising: a belt being configured and disposed to run in an endless loop; a drive element being configured to drive said belt in an endless loop; a belt carrier element being disposed non-rotationally in said closing machine and being configured and disposed to hold said belt; a plurality of rollers being disposed on said belt carrier element; said belt being disposed around said plurality of rollers; a loop length of said belt being disposed between two of said plurality of rollers and towards bottles in the process of being closed in said closing arrangement; said loop length being configured to move synchronously at substantially the same speed and in the same direction as containers that come into contact with said loop length; said belt system being configured and disposed to contact screwtop bottles along said loop length, and to press a screwtop bottle against said container carrier element to substantially prevent rotation of a screwtop bottle during the bottle closing process; a second conveyor arrangement being configured and disposed to move bottles out of said beverage bottle screwtop closing arrangement; and said second conveyer arrangement comprising a star wheel structure.

A further feature or aspect of an embodiment is believed at the time of the filing of this patent application to possibly reside broadly in a screwtop container closing arrangement configured to screw screwtops onto screwtop containers in a container filling plant, said screwtop container closing arrangement comprising: a container inlet being configured and disposed to permit containers to enter said screwtop container closing arrangement; at least one screw capper being configured to screw screw caps onto screwtop containers; a container holding arrangement being configured and disposed to receive and hold, lift and lower screwtop containers to permit screw caps to be screwed onto screwtop containers by said screw capper; said container holding arrangement comprising a friction structure being configured and disposed to minimize screwtop bottle rotation during container closing; a lifting apparatus being configured and disposed to lift said container holding arrangement in a first lifting direction toward its corresponding screw capper, and to move said container holding arrangement in a second lowering direction away from its corresponding screw capper upon screwtop containers being closed; a flexible elongated element system being configured and disposed to secure screwtop containers from rotating during the container closing process; said flexible elongated element system comprising: a flexible elongated element being configured and disposed to contact screwtop containers in said screwtop container closing arrangement; a drive element being configured to drive said flexible elongated element; a portion of said flexible elongated element being configured to be disposed toward and to be in contact with containers in said screwtop container closing arrangement; said portion of said flexible elongated element being configured to synchronously move at substantially the same speed and in the same direction as containers in said screwtop container closing arrangement that come into contact with said portion of said flexible elongated element; said portion of said flexible elongated element being configured to press containers against said friction structure to minimize rotation of containers during container closing; a container outlet being configured and disposed to permit closed containers to exit said screwtop container closing arrangement.

Another feature or aspect of an embodiment is believed at the time of the filing of this patent application to possibly reside broadly in a screwtop container closing arrangement configured to screw screwtops onto screwtop containers in a container filling plant, said screwtop container closing arrangement comprising: a container inlet being configured and disposed to permit containers to enter said screwtop container closing arrangement; at least one screw capper being configured to screw screw caps onto screwtop containers; a container holding arrangement being configured and disposed to receive and hold screwtop containers to permit screw caps to be screwed onto screwtop containers by said screw capper; a flexible elongated element system being configured and disposed to assist screwtop containers in having their caps tightened during the container closing process; said flexible elongated element system comprising: a flexible elongated element being configured and disposed to contact screwtop containers in said screwtop container closing arrangement; a drive element being configured to drive said flexible elongated element; said flexible elongated element being configured to have a portion disposed toward and to be in contact with containers in said screwtop container closing arrangement; said portion of said flexible elongated element being configured to move at a speed and in a direction to assist containers in having their caps tightened during the container closing process; a container outlet being configured and disposed to permit closed containers to exit said screwtop container closing arrangement.

The components disclosed in the various publications, disclosed or incorporated by reference herein, may possibly be used in possible embodiments of the present invention, as well as equivalents thereof.

Some examples of bottling systems, which may be used or adapted for use in at least one possible embodiment of the present may be found in the following U.S. Patents assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

Some examples of methods and apparatuses for closing bottles and containers and their components that may possibly be utilized or possibly adapted for use in at least one possible embodiment of the present may possibly be found in the following U.S. patents: U.S. Pat. No. 5,398,485 issued to Osifchin on Mar. 21, 1995; U.S. Pat. No. 5,402,623 issued to Ahlers on Apr. 4, 1995; U.S. Pat. No. 5,419,094 issued to Vander Bush, Jr. et al. on May 30, 1995; U.S. Pat. No. 5,425,402 issued to Pringle on Jun. 20, 1995; U.S. Pat. No. 5,447,246 issued to Finke on Sep. 5, 1995; and U.S. Pat. No. 5,449,080 issued to Finke on Sep. 12, 1995.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Some examples of filling machines that utilize electronic control devices to control various portions of a filling or bottling process and that may possibly be utilized or possibly adapted for use in at least one possible embodiment of the present application may possibly be found in the following U.S. patents: U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025 issued to Yasui on Feb. 15, 2000.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

Some examples of synchronous motors which may possibly be utilized or adapted for use in at least one possible embodiment may possibly be found in the following U.S. Patents: U.S. Pat. No. 6,713,899, entitled "Linear synchronous motor;" U.S. Pat. No. 6,486,581, entitled "Interior permanent magnet synchronous motor;" U.S. Pat. No. 6,424,114, entitled "Synchronous motor;" U.S. Pat. No. 6,388,353, entitled "Elongated permanent magnet synchronous motor;" U.S. Pat. No. 6,329,728, entitled "Cylinder-type linear synchronous motor;" U.S. Pat. No. 6,025,659, entitled "Synchronous motor with movable part having permanent magnets;" U.S. Pat. No. 5,936,322, entitled "Permanent magnet type synchronous motor;" and U.S. Pat. No. 5,448,123, entitled "Electric synchronous motor."

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of lifting devices that may possibly be utilized or possibly adapted for use in at least one possible embodiment of the present application may possibly be found in the following patent publications: U.S. Pat. No. 2,535,272 issued to Detrez on Dec. 26, 1950; U.S. Pat. No. 2,642,214 issued to Lippold on Jun. 16, 1953; German Utility Model No. DE-GM 1,923,261 issued on Sep. 9, 1965; German Laid Open Patent Application No. DE-OS 1,532,586 published on Oct. 2, 1969; British Patent No. 1,188,888 issued Apr. 22, 1970; German Laid Open Patent Application No. DE-OS 26 52 910 published on May 24, 1978; German Patent No. DE-PS 26 52 918 issued on Oct. 26, 1978; German Utility Model No. DE-GM 83 04 995 issued on Dec. 22, 1983; German Patent No. DE-PS 26 30 100 issued on Dec. 3, 1981; and German Laid Open Patent Application No. DE-OS 195 45 080 published on Jun. 5, 1997.

The corresponding foreign patent publication applications, namely, Federal Republic of Germany Patent Application No. 10 2004 056 040.4-23, filed on Nov. 19, 2004, having inventor Herbert Bernhard, and DE-OS 10 2004 056 040.4-23 and DE-PS 10 2004 056 040.4-23, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

Some examples of computer systems that may possibly be utilized or possibly adapted for use in at least one possible embodiment of the present application may possibly be found in the following U.S. Patents: U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

Some examples of belt drives, components of which may possibly be utilized in at least one possible embodiment may possibly be found in the following U.S. Patents: U.S. Pat. No. 6,938,544, entitled "Belt drive;" U.S. Pat. No. 6,866,603, entitled "Counter-rotational drive belt system and method;" and U.S. Pat. No. 6,090,001, entitled "Belt system."

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL LIST OF TERMS

| | |
|---|---|
| 1 | Capping machine |
| 1.1 | Machine part |

-continued

AT LEAST PARTIAL LIST OF TERMS

| | |
|---|---|
| 2 | Bottle |
| 2.1 | Flange |
| 3 | Bottle cap |
| 4 | Rotor of the capping machine |
| 5 | Capping position |
| 6 | Bottle carrier |
| 7 | Capping tool or cone |
| 8 | Shaft |
| 9 | Drive system for capping cone |
| 10 | Lifting rod |
| 11 | Holder |
| 12 | Guide rod |
| 13 | Molding as lateral bottle stop |
| 14 | Friction lining |
| 15 | Cam roller |
| 16 | Lifting cam |
| 17 | Closed loop |
| 17.1 | Loop length |
| 18 | Belt |
| 19-23 | Roller |
| 24 | Air or gas spring or pneumatic cylinder |
| 25 | Carrier |
| 26 | Belt system |
| MA | Machine axis |
| Arrow A | Reciprocating movement of the lifting rod 10 |
| Arrow B | Direction of movement of the belt 18 in the loop length 17.1 |

What is claimed is:

1. A screwtop container closing arrangement configured to screw screw caps onto screwtop containers in a container filling plant, said screwtop container closing arrangement comprising:

a container inlet being configured and disposed to permit containers to enter said screwtop container closing arrangement;

at least one screw capper being configured to screw screw caps onto screwtop containers;

a container holding arrangement being configured and disposed to receive and hold, lift and lower screwtop containers to permit screw caps to be screwed onto screwtop containers by said screw capper;

said container holding arrangement comprising a friction structure being configured and disposed to minimize screwtop bottle rotation during container closing;

a lifting apparatus being configured and disposed to lift said container holding arrangement in a first lifting direction toward its corresponding screw capper, and to move said container holding arrangement in a second lowering direction away from its corresponding screw capper upon screwtop containers being closed;

a flexible elongated element system being configured and disposed to secure screwtop containers from rotating during the container closing process;

said flexible elongated element system comprising:

a flexible elongated element being configured and disposed to contact screwtop containers in said screwtop container closing arrangement;

a drive element being configured to drive said flexible elongated element;

a portion of said flexible elongated element being configured to be disposed toward and to be in contact with containers in said screwtop container closing arrangement;

said portion of said flexible elongated element being configured to synchronously move at substantially the same speed and in the same direction as containers in said screwtop container closing arrangement that come into contact with said portion of said flexible elongated element;

said portion of said flexible elongated element being configured to press containers against said friction structure to minimize rotation of containers during container closing;

a container outlet being configured and disposed to permit closed containers to exit said screwtop container closing arrangement.

2. The screwtop container closing arrangement according to claim 1 wherein said portion of said flexible elongated element is offset radially outward with respect to said friction structure.

3. The screwtop container closing arrangement according to claim 2, wherein said portion of said flexible elongated element extends over at least one angular area of the rotational motion of said rotor in which the tightening process occurs.

4. The screwtop container closing arrangement according to claim 3, wherein said portion of said flexible elongated element is configured to ascend upwardly in the direction of motion of said portion of said flexible elongated element.

5. The screwtop container closing arrangement according to claim 4, comprising a cam structure being configured and disposed to raise and lower said container holding arrangement; and wherein the ascent of said portion of said flexible elongated element is equal to the movement of a container raised by said cam structure that controls the movement of its respective container carrier element to maintain contact of said portion to a specific part of a container making contact with said portion.

6. The screwtop container closing arrangement according to claim 5, wherein said portion of said flexible elongated element is guided by a plurality of rollers and that at least one of said plurality of rollers is driven.

7. The screwtop container closing arrangement according to claim 6, wherein said portion of said flexible elongated element that is in contact against containers extends between at least two of said plurality of rollers, and that the final roller of said portion of said flexible elongated element is driven in the direction of rotation of said rotor.

8. The screwtop container closing arrangement according to claim 7, wherein said plurality of rollers are mounted on a common carrier, which common carrier is inclined with respect to the horizontal to provide the ascent of said portion of said flexible elongated element.

9. A screwtop container closing arrangement configured to screw screw caps onto screwtop containers in a container filling plant, said screwtop container closing arrangement comprising:

a container inlet being configured and disposed to permit containers to enter said screwtop container closing arrangement;

at least one screw capper being configured to screw screw caps onto screwtop containers;

a container holding arrangement being configured and disposed to receive and hold screwtop containers to permit screw caps to be screwed onto screwtop containers by said screw capper;

a flexible elongated element system being configured and disposed to assist screwtop containers in having their caps tightened during the container closing process;

said flexible elongated element system comprising:

a flexible elongated element being configured and disposed to contact screwtop containers in said screwtop container closing arrangement;

a drive element being configured to drive said flexible elongated element;

said flexible elongated element being configured to have a portion disposed toward and to be in contact with containers in said screwtop container closing arrangement;

said portion of said flexible elongated element being configured to move at a speed and in a direction to assist containers in having their caps tightened during the container closing process;

a container outlet being configured and disposed to permit closed containers to exit said screwtop container closing arrangement; and said portion of said flexible elongated element is offset radially outward with respect to said container holding arrangement.

10. The screwtop container closing arrangement according to claim 9, wherein said portion of said flexible elongated element extends over at least one angular area of the rotational motion of said rotor in which the tightening process occurs.

11. The screwtop container closing arrangement according to claim 10, wherein said portion of said flexible elongated element is configured to ascend upwardly in the direction of motion of said portion of said flexible elongated element.

12. The screwtop container closing arrangement according to claim 11, comprising a cam structure being configured and disposed to raise and lower said container holding arrangement; and wherein the ascent of said portion of said flexible elongated element is equal to the movement of a container raised by said cam structure that controls the movement of its respective container carrier element to maintain contact of said portion to a specific part of a container making contact with said portion.

13. The screwtop container closing arrangement according to claim 12, wherein said flexible elongated element is guided by a plurality of rollers and that at least one of said plurality of rollers is driven.

14. The screwtop container closing arrangement according to claim 13, wherein said flexible elongated element that is in contact against containers extends between at least two of said plurality of rollers, and that the final roller of said flexible elongated element is driven in the direction of rotation of said rotor.

15. The screwtop container closing arrangement according to claim 14, wherein said rollers are mounted on a common carrier, which common carrier is inclined with respect to the horizontal to provide the ascent of said flexible elongated element.

16. A screwtop beverage bottle capping arrangement for screwing screw caps onto filled screwtop beverage bottles in a beverage bottling plant, said screwtop beverage bottle capping arrangement comprising:

an input star wheel structure being configured and disposed to move bottles into said capping arrangement;

an output star wheel structure being configured and disposed to move bottles out of said capping arrangement;

a rotor being disposed on a vertical axis;

a motor system being configured to rotate said rotor about a vertical axis;

a rotatable vertical machine column;

said rotor being connected to said vertical machine column to permit rotation of said rotor about said vertical machine column;

a plurality of screw capping devices being disposed on the periphery of said rotor;

each of said plurality of screw capping devices comprising:

a screw head being configured to hold screw caps;

a drive motor being configured and disposed to drive said screw head to screw a screw cap onto a screwtop bottle;

a container carrier element being configured and disposed to receive and hold screwtop bottles;

said container carrier element comprising a friction lining being configured and disposed to substantially prevent screwtop bottles from rotating during bottle capping;

a lifting apparatus being configured and disposed to lift said container carrier element in a first lifting direction toward its corresponding screw head, and to move said container carrier element in a second lowering direction away from its corresponding screw head upon screwtop bottles being closed;

a cam structure being connected to said lifting apparatus;

said cam structure being configured and disposed to lift said lifting apparatus in a first lifting direction toward its corresponding screw head, and to hold said lifting apparatus in a position to permit a screw cap to be screwed onto a screwtop bottle;

said cam structure being configured and disposed to move said lifting apparatus in a second lowering direction away from its corresponding screw head upon screwtop bottles being closed;

a belt system being configured and disposed to secure screwtop bottles from rotating during the bottle closing process;

said belt system comprising:

a belt being configured and disposed to run in an endless loop;

a drive element being configured to drive said belt in an endless loop;

a belt carrier element being disposed non-rotationally in said capping arrangement and being configured and disposed to hold said belt;

a plurality of rollers being disposed on said belt carrier element;

said belt being disposed around said plurality of rollers;

a loop length of said belt being disposed between two of said plurality of rollers and towards bottles in the process of being closed in said capping arrangement; and said loop length being configured to move synchronously at substantially the same speed and in the same direction as containers that come into contact with said loop length; and said belt system being configured and disposed to contact screwtop bottles along said loop length, and to press a screwtop bottle against said container carrier element to substantially prevent rotation of a screwtop bottle during the bottle closing process.

17. The beverage bottle screwtop capping arrangement according to claim 16, wherein:

said loop length is offset radially outward with respect to said friction lining; and said loop length extends over at least one angular area of the rotational motion of said rotor in which the tightening process occurs.

18. The beverage bottle screwtop capping arrangement according to claim 17, wherein:

said loop length is configured to ascend upwardly in the direction of motion of said belt; and the ascent of said loop length is equal to the movement of a container raised by said cam structure that controls the movement of its respective container carrier element to maintain contact of said loop length to a specific part of a container making contact with said loop length.

19. The beverage bottle screwtop capping arrangement according to claim 18, wherein:

said belt is guided by a plurality of rollers and that at least one of said plurality of rollers is driven;

said loop length that is in contact against the containers extends between at least two of said plurality of rollers, and that the final roller of said loop length is driven in the direction of rotation of said rotor; and said plurality of rollers are mounted on a common carrier, wherein said common carrier is inclined with respect to a horizontal to provide the ascent of said loop length.

* * * * *